US012098482B2

(12) United States Patent
Schneider et al.

(10) Patent No.: US 12,098,482 B2
(45) Date of Patent: Sep. 24, 2024

(54) TEXTILE FLAT STRUCTURE FOR ELECTRICAL INSULATION

(71) Applicant: Carl Freudenberg KG, Weinheim (DE)

(72) Inventors: Ulrich Schneider, Darmstadt (DE); Gerald Jarre, Weinheim (DE); Michael Zaplatilek, Birkenau (DE); Andrea Jaeger, Heddesheim (DE)

(73) Assignee: CARL FREUDENBERG KG, Weinheim (DE)

( * ) Notice: Subject to any disclaimer, the term of this patent is extended or adjusted under 35 U.S.C. 154(b) by 324 days.

(21) Appl. No.: 16/611,865

(22) PCT Filed: Apr. 6, 2018

(86) PCT No.: PCT/EP2018/058832
§ 371 (c)(1),
(2) Date: Nov. 8, 2019

(87) PCT Pub. No.: WO2018/206203
PCT Pub. Date: Nov. 15, 2018

(65) Prior Publication Data

US 2020/0115826 A1 Apr. 16, 2020

(30) Foreign Application Priority Data

May 11, 2017 (DE) ..... 10 2017 004 481.3

(51) Int. Cl.
*D01F 8/14* (2006.01)
*D04H 1/541* (2012.01)
(Continued)

(52) U.S. Cl.
CPC ..... *D01F 8/14* (2013.01); *D04H 1/5412* (2020.05); *D04H 1/5418* (2020.05);
(Continued)

(58) Field of Classification Search
CPC ..... D01F 8/14; D04H 1/5412; D04H 1/5418; D04H 1/587; D04H 1/60; D04H 3/011;
(Continued)

(56) References Cited

U.S. PATENT DOCUMENTS 6,254,987 B1 7/2001 Delker
2002/0193030 A1 12/2002 Li
(Continued)

FOREIGN PATENT DOCUMENTS

CN 102245823 A 11/2011
EP 0669358 A1 * 8/1995 ..... C08G 63/06
(Continued)

OTHER PUBLICATIONS

Shi, et al.: "Glass-Transition and Melting Behavior of Poly(ethylene terephthalate)/Poly(ethylene 2,6-naphthalate) Blends," *Journal of Applied Polymer Science* 81, 1: 11-22 (Jul. 5, 2001). XP055153866.
(Continued)

*Primary Examiner* — Jennifer A Gillett
(74) *Attorney, Agent, or Firm* — LEYDIG, VOIT & MAYER, LTD.

(57) ABSTRACT

A textile fabric includes: a base body having at least one layer, the at least one layer comprising PEN, copolymers, and/or blends thereof as a binding component. The binding component is obtainable by applying temperatures above a glass transition temperature of a binding fiber sheath polymer to core/sheath binding fibers, in which the binding fiber sheath polymer contains PEN, copolymers, and/or blends thereof.

18 Claims, 4 Drawing Sheets

(51) Int. Cl.

| | |
|---|---|
| ***D04H 1/587*** | (2012.01) |
| ***D04H 1/60*** | (2006.01) |
| ***D04H 3/011*** | (2012.01) |
| ***D04H 3/147*** | (2012.01) |

(52) U.S. Cl.
CPC ..... *D04H 1/587* (2013.01); *D04H 1/60* (2013.01); *D04H 3/011* (2013.01); *D04H 3/147* (2013.01)

(58) Field of Classification Search
CPC ..... D04H 3/147; D04H 1/435; D04H 1/541; C08G 63/189
See application file for complete search history.

(56) References Cited

U.S. PATENT DOCUMENTS

2003/0157322 A1* 8/2003 Boyd ..... D01F 8/04 428/373
2004/0265577 A1* 12/2004 Goda ..... D04H 1/435 428/364
2008/0001431 A1* 1/2008 Thompson ..... B60R 13/08 181/290
2008/0308490 A1 12/2008 Frey et al.
2011/0012474 A1 1/2011 Levit et al.
2011/0040009 A1* 2/2011 Shimida ..... D01F 6/62 524/407
2014/0235128 A1* 8/2014 Shimada ..... D04H 1/5418 442/334
2015/0013295 A1* 1/2015 Uchiyama ..... B01D 71/48 55/524
2016/0222557 A1* 8/2016 Jarre ..... D04H 3/147

FOREIGN PATENT DOCUMENTS

| | | | |
|---|---|---|---|
| EP | 0976854 | A1 | 2/2000 |
| JP | S5898426 | A | 6/1983 |
| JP | S5898526 | A | 6/1983 |
| JP | H11-76651 | A | 3/1999 |
| JP | 2977679 | B2 | 11/1999 |
| JP | 2005520067 | A | 7/2005 |
| KR | 100488245 | B1 | 4/2005 |
| KR | 20100099681 | A | 9/2010 |
| WO | WO 2006105836 | A1 | 10/2006 |
| WO | WO 2009134024 | A2 | 11/2009 |
| WO | WO 2015049027 | A1 | 4/2015 |

OTHER PUBLICATIONS

Chen, Xing-bo et al. "Thermal Performance and Crystallinity of Low Melting Point Polyester Fiber for Special Paper," Paper and Paper Making, vol. 35, No. 3, Mar. 2016, pp. 17-21.

* cited by examiner

TEXTILE FLAT STRUCTURE FOR ELECTRICAL INSULATION

CROSS-REFERENCE TO PRIOR APPLICATIONS

This application is a U.S. National Phase application under 35 U.S.C. § 371 of International Application No. PCT/EP2018/058832, filed on Apr. 6, 2018, and claims benefit to German Patent Application No. DE 10 2017 004 481.3, filed on May 11, 2017. The International Application was published in German on Nov. 15, 2018 as WO/2018/206203 under PCT Article 21(2).

FIELD

The invention relates to a textile fabric, in particular for the electrical insulation of electrical devices.

BACKGROUND

The use of textile fabrics for the electrical insulation of electrical devices is known from the prior art. Textile fabrics are used, for example, for the electrical insulation of electric motors, generators or transformers. In this case, films (e.g., PET, PEN, PI, etc.) are laminated with the corresponding non-wovens so that 2 or 3 layers of laminate with the construction of non-woven-film, or non-woven-film-non-woven are produced. The classic technical term for this is DMD (Dacron-Mylard-Dacron). The laminates are then used in motors/generators/transformers for insulation, for example as a slot insulation, sliding cover, field coil insulation, armature insulation.

Important requirements for the non-woven fabric here are: good laminating ability, resin absorption, uniformity of fiber distribution and thickness, high level of smoothness and as high a continuous temperature resistance as possible. The non-woven can, however, also be used directly, for example for phase insulation/separation or all-round insulation. In this case, the non-woven is subsequently provided with a resin and thus gains its electrically insulating effect.

Important requirements for the non-woven fabric here are: resin absorption and transfer, uniformity of the fiber distribution, as high a continuous temperature resistance as possible, sufficient mechanical properties for deformation processes. A further field of application for such non-wovens are carriers for conductive strips, which are used, for example, in the winding of Roebel bars.

Important requirements for the non-woven fabric here are: good impregnation behavior, air permeability→conductivity through plane, as high a continuous temperature resistance as possible, sufficient mechanical properties for winding processes.

US 2011/0012474 A1 discloses an electrical laminate insulation element for an electrical device, comprising a thermoplastic film positioned between, adjacent to, and fastened to two non-woven sheets, each of the non-woven sheets being made of polymeric multi-component fibers. The multi-component fibers may be core-sheath fibers in which the high-melting polymer forms the sheath and the low-melting polymer forms the core of the fiber. In a preferred embodiment, the core consists of the low-melting polymer (PET) and the sheath consists of the high-melting polymer (PPS).

A disadvantage of the laminate insulation element described is that it contains sulfur. In the case of its degradation in the long-term application, there is the risk that acids and other sulfur compounds form and corrosion thus occurs. The presence of sulfur is therefore not desired in the field of electrical insulation. Moreover, in the case of multicomponent fibers, an incompatibility of PPS and PET must be considered, which makes it difficult to produce PPS/PET bico fibers, for example, and makes it necessary to use PPS in a relatively large amount or to use special and thus complex core geometries.

WO 2006105836 A1 describes a thermally bonded non-woven containing a low-shrinkage core-sheath bicomponent fiber, wherein the low-shrinkage core-sheath bicomponent fiber consists of a crystalline polyester core and a crystalline polyester sheath, which melts at least 10° C. lower and has a heat shrinkage at 170° C. of less than 10%. In a preferred embodiment, the core consists of polyethylene naphthalate (PEN). The non-woven is used as a filter medium, membrane support non-woven and battery separator. It has excellent properties for these applications. However, especially for electrical insulation, it has the disadvantage that it has too low a thermal stability due to the relatively low glass transition temperature of the polyester sheath.

SUMMARY

In an embodiment, the present invention provides a textile fabric, comprising: a base body having at least one layer, the at least one layer comprising PEN, copolymers, and/or blends thereof as a binding component, wherein the binding component is obtainable by applying temperatures above a glass transition temperature of a binding fiber sheath polymer to core/sheath binding fibers, in which the binding fiber sheath polymer contains PEN, copolymers, and/or blends thereof.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
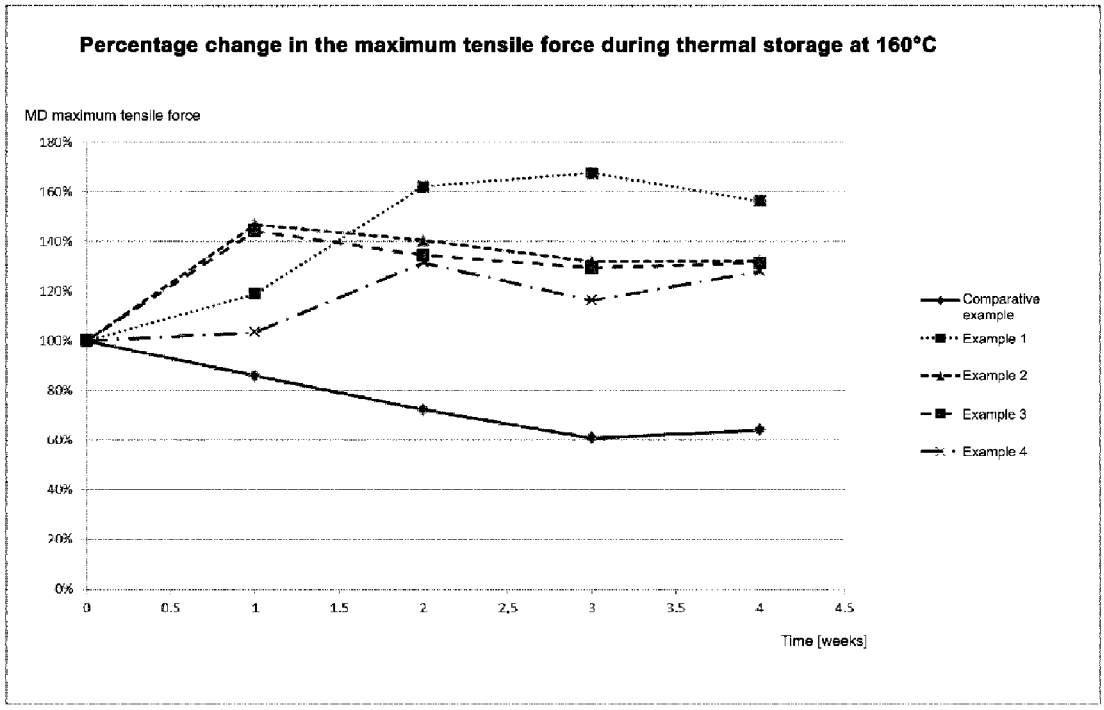
FIGS. 1-4 show results of the fabric according to the invention and the comparative example being subjected to storage tests at 160° C. or 200° C.

In an embodiment, the present invention provides a textile fabric for electrical insulation, for example for the electrical insulation of electric motors, generators or transformers, which at least partially eliminates the aforementioned disadvantages.

The present invention solves the aforementioned problem by a textile fabric comprising a base body having at least one layer, wherein the at least one layer comprises PEN, copolymers and/or blends thereof as a binding component, wherein the binding component is obtainable by applying temperatures above the glass transition temperature of the binding fiber sheath polymer to core/sheath binding fibers, in which the binding fiber sheath polymer contains PEN, copolymers and/or blends thereof.

According to the invention, it has been found that core/sheath fibers in which the sheath comprises PEN, copolymers and/or blends thereof are outstandingly suitable for providing high-temperature-resistant textile fabrics for electrical insulation. The PEN, copolymers and/or blends thereof are present as a binding component in the fabric according to the invention. The binding component can be present in the form of a more or less deformed fiber structure right up to a completely fused continuous phase.

The use of PEN, copolymers and/or blends thereof as a binding component is unusual in the art since these materials generally have a rather high melting point. However, it has been found according to the invention that it is possible to also use these materials below their melting point as a binding component if their degree of crystallinity is set low. Thus, the binding component can be produced starting from core/sheath binding fibers in which the binding fiber sheath polymer comprises PEN, copolymers and/or blends thereof having a degree of crystallinity of less than 80%, for example from 0 to 75%, more preferably from 0 to 70% and in particular from 0 to 60%. This means that the binding fiber sheath polymer used for producing the binding component preferably has one of the aforementioned degrees of crystallinity.

A low degree of crystallization can be achieved in a simple manner by the core/sheath binding fibers used for producing the fabric according to the invention being non-drawn fibers, i.e., fibers with a high proportion of amorphous PEN, amorphous copolymers and/or amorphous blends thereof. In practical experiments, it was found that these amorphous materials already achieve a binding capacity (cold crystallization) during a thermally induced recrystallization below the melting point. The term "cold crystallization temperature" refers to the temperature at which a first exothermic maximum of the free enthalpy occurs. The term "exothermic" refers to energy release. Core/sheath binding fibers can hereby be obtained which are thus suitable for customary binding processes in the textile industry, for example calendering.

The use of PEN is advantageous in that it is characterized by very high thermal-electrical resistance in the product. In addition, PEN is very compatible with a wide variety of technically relevant polymers, such as polyesters, and is thus easy to spin as a sheath in a core/sheath fiber. Smaller sheath thicknesses can thus also be realized. In addition, the long-term stability can be increased as a result of the improved interface due to the good compatibility of the polymers in their structure. Another advantage of using PEN compared to PPS is that it does not contain sulfur.

Since the PEN, copolymers and/or blends thereof are present according to the invention in the sheath of the core/sheath binding fibers used for producing the textile fabric, its advantageous properties, in particular its high thermal-electrical resistance and long-term stability, can be utilized particularly well. In addition, it can thereby function as protection for the internal fiber component.

Moreover, it has been shown in practical experiments that the fabric according to the invention has excellent storage stability, which is manifested, for example, in that the PEN-containing binding component has virtually no deterioration or even has an increase in strength during thermal storage (see FIGS. 1-4). Thus, after thermal storage at 160° C. for 1 week, the fabric according to the invention preferably exhibits a percentage reduction in the maximum tensile force in at least one direction of less than 5%, preferably of less than 4%, for example of 0 to 4%, and/or an increase in the maximum tensile force in at least one direction of at least 1%, preferably of more than 5%, for example of 5 to 100%.

Without specifying a mechanism according to the invention, it is assumed that the good storage stability is attributable to the PEN having a comparatively high glass transition temperature. In addition, the degree of crystallization of the PEN component increases with time, which counteracts destabilization by thermal degradation processes.

Preferably, the PEN, copolymers, and/or blends thereof in the binding fiber sheath polymer has a cold crystallization temperature in the range of 70 to 200° C., more preferably in the range of 80 to 190° C., most preferably in the range of 90 to 175° C.

Also preferably, the PEN, copolymers and/or blends thereof in the binding fiber sheath polymer and/or in the binding component has a melting temperature in the range of 180 to 320° C., more preferably in the range of 210 to 310° C., most preferably in the range of 230 to 300° C. These polymers are very suitable for thermal binding.

According to the invention, the binding component comprises PEN, copolymers and/or blends thereof. The term "PEN" is understood to mean polyethylene naphthalate. This can be present as a homopolymer, copolymer and/or blend thereof, the PEN being present as a main component in the copolymers and/or blends, preferably in a proportion of more than 40 wt. %, more preferably of more than 50 wt. % and more preferably of more than 60 wt. % and in particular of more than 90 wt. %. Examples of suitable copolymers are statistical copolymers, gradient copolymers, alternating copolymers, block copolymers or graft polymers. The copolymers may consist of two, three, four or more different monomers (terpolymers, tetrapolymers). Particularly preferred further comonomers are monomers of the following polymers: aromatic and aliphatic polyesters, aromatic and aliphatic polyamides, aromatic and aliphatic epoxides, aromatic and aliphatic polyurethanes, polysiloxanes, polyacrylates, polyacrylamides.

When the PEN is used as a blend, preferred further blend components are polymers having a melting temperature in the range of 180 to 320° C., more preferably in the range of 210 to 300° C., most preferably in the range of 230 to 290° C., and/or with a decomposition point in the range of 210 to 800° C., more preferably in the range of 300 to 750° C., most preferably in the range of 350 to 700° C. Particularly preferred further blend components are the following: aromatic polyesters, aromatic polyamides, polyether ether ketone, poly(p-phenylene-2,6-benzobisoxazole), polyamide-imide, polyphenylene sulfide.

When PEN is used as homopolymer, the PEN is preferably present in the binding fiber sheath polymer in a proportion of more than 50 wt. %, more preferably of more than 75 wt. %, more preferably of more than 90 wt. %, and in particular of about 100 wt. %, based in each case on the total weight of the sheath, wherein customary additives, such as spin aids, nucleation additives, matting agents and impurities, such as catalyst residues, are not to be considered.

Adhesive binding of the fabric can be effected by the binding component.

According to the invention, the fabric is preferably a non-woven. A non-woven is a fabric consisting of fibers of limited length, continuous fibers (filaments) or cut yarns of any type and of any origin which have in some way been joined together to form a non-woven (a fibrous layer, a fibrous web) and have in some way been connected to one another; excluded therefrom is the interlacing or interweaving of yarns, as occurs during weaving, warp-knitting, knitting, lace-making, braiding and the production of tufted products. Non-woven fabrics do not include films and papers.

According to the invention, the core/sheath binding fibers used to produce the textile fabric preferably comprise a polymer (binding fiber core polymer) in the core that is different from the sheath polymer. Upon heating of the core/sheath binding fibers, the binding fiber core polymer may also or may not (partially) bind. In this case, the binding fiber core polymer can be partially or completely enclosed by the binding component. The ratio between binding fiber core and binding fiber sheath polymer can be freely selected. Ratios of 90:10 to 10:90 (core:sheath weight ratio in wt. %), more preferably of 80:20 to 20:80, more preferably of 80:20 to 30:70 and in particular of 80:20 to 40:60 have proven particularly favorable.

According to a particularly preferred embodiment, the binding fiber sheath polymer has a higher melting point than the binding fiber core polymer. In this case, the difference in the melting temperatures of the binding fiber sheath polymer and of the binding fiber core polymer is preferably at least 2.5° C., preferably at least 5° C., particularly preferably at least 7.5° C. Preference is given to using polymers having a temperature difference of from 2.5 to 200° C., more preferably from 5 to 150° C., more preferably from 7.5 to 100° C. This difference in the melting temperatures of the two polymers results in good temperature stability.

According to a particularly preferred embodiment, the binding fiber sheath polymer has a glass transition temperature that is higher by at least 5° C. than that of the binding fiber core polymer, preferably at least 10° C., particularly preferably at least 15° C. Preference is given to using polymers having a difference in the glass transition temperature of from 5 to 600° C., more preferably from 10 to 500° C., particularly preferably from 15 to 200° C.

The binding fiber core polymer may contain a variety of materials. Preferably, the binding fiber core polymer is melt spinnable. The binding fiber core polymer is preferably a polyester selected from the group consisting of polyethylene terephthalate, polypropylene terephthalate, polytetramethyl enterephthalate, poly(decamethylene)-terephthalate, poly-1,4-cyclohexylene dimethyl terephthalate, polybutylene terephthalate, polyethylene naphthalate, polyglycolic acid, polylactides, polycaprolactones, polyethylene adipates, polyhydroxyalkanoates, polyhydroxybutyrates, poly-3-hydroxybutyrate-co-3-hydroxyvalerate, polytrimethylene terephthalate, Vectran, polyethylene naphthalate, copolymers thereof and/or mixtures thereof. Fabrics containing the aforementioned polymers can be recycled well.

Furthermore, the binding fiber core polymer is most preferably selected from the group consisting of poly(decamethylene)-terephthalate, poly-1,4-cyclohexylene dimethyl terephthalate, polybutylene terephthalate, polyethylene naphthalate, more preferably polyethylene naphthalate, polybutylene terephthalate, copolymers thereof and/or blends thereof.

According to a preferred embodiment, the binding fiber core polymer contains polyethylene terephthalate and/or co-polyethylene terephthalate. Examples of suitable copolymers are statistical copolymers, gradient copolymers, alternating copolymers, block copolymers or graft polymers. The copolymers may consist of two, three, four or more different monomers (terpolymers, tetrapolymers). Particularly preferred further comonomers are monomers of the following polymers: aromatic and aliphatic polyesters, aromatic and aliphatic polyamides, aromatic and aliphatic epoxides, aromatic and aliphatic polyurethanes, polysiloxanes, polyacrylates, polyacrylamides.

The proportion of the aforementioned polymers in the binding fiber core polymer is preferably from 5 to 100 wt. %, more preferably from 50 to 100 wt. % and in particular from 75 to 100 wt. %, based in each case on the total weight of the core, wherein customary additives, such as spin aids, nucleation additives, matting agents and impurities, such as catalyst residues, are not to be considered.

When a blend is used as a binding fiber core polymer, preferred further blend components are polymers having a melting temperature in the range of 180 to 320° C., more preferably in the range of 210 to 300° C., most preferably in the range of 230 to 290° C., and/or with a decomposition point in the range of 210 to 800° C., more preferably in the range of 300 to 750° C., most preferably in the range of 350 to 700° C. Particularly preferred further blend components are the following: aromatic polyesters, aromatic polyamides, polyether ether ketone (PEEK), polybenzobisoxazole (PBO), polyamide-imide (PAI), polyphenylene sulfide (PPS).

By suitable selection of the polymers used, the temperature stability and the mechanical properties, in particular the elasticity, deformability and strength of the fabric, can be influenced.

Also preferably, the binding fiber core polymer has a melting temperature in the range of 180 to 320° C., more preferably in the range of 210 to 300° C., most preferably in the range of 230 to 290° C., and/or a decomposition point in the range of 210 to 800° C., more preferably in the range of 300 to 750° C., most preferably in the range 350 to 700° C.

In a preferred embodiment of the invention, the fabric contains matrix fibers. Unlike the binding component, the matrix fibers are present in a significantly more distinct fiber form. The cores of the core/sheath binding fibers used to produce the fabric can act as matrix fibers. Particularly preferably, however, in addition to or alternatively to the cores of the core/sheath binding fibers, further fibers are used as matrix fibers. An advantage of the presence of the matrix fibers is that the stability of the fabric as a whole can be increased.

Preferably, the difference in the degree of crystallinity between the sheath of the core/sheath binding fibers and the degree of crystallinity of the matrix fibers prior to the thermal treatment is at least 5%, for example from 5 to 80%, more preferably at least 7.5%, for example from 7.5 to 70% and in particular at least 10%, for example from 10 to 60%, wherein the degree of crystallinity of the matrix fibers is higher than the degree of crystallinity of the sheath of the core/sheath binding fibers. Core/sheath binding fibers with a low degree of crystallinity can be obtained in a simple manner, for example by means of melt spinning, in which a drawing step is dispensed with.

In a particularly preferred embodiment of the invention, the matrix fibers are formed as core/sheath matrix fibers comprising a matrix fiber sheath polymer and a matrix fiber core polymer. Preferably, the difference in the degree of crystallinity between the sheath of the core/sheath binding fibers and the degree of crystallinity of the matrix fiber sheath polymer prior to the thermal treatment is at least 5%, for example from 5 to 80%, more preferably at least 7.5%, for example from 7.5 to 70% and in particular at least 10%, for example from 10 to 60%, wherein the degree of crystallinity of the matrix fiber sheath polymer is higher than the degree of crystallinity of the sheath of the core/sheath binding fibers.

The matrix fiber sheath polymer may be selected from the same polymers as described for the sheath polymer of the core/sheath binding fibers used to produce the binding component. The matrix fiber core polymer can also be selected from the same polymers as described for the core polymer of the core/sheath binding fibers used to produce the binding component.

Preferably, the matrix fiber sheath polymer is selected from PEN, copolymers and/or blends thereof and/or the matrix fiber core polymer comprising polyethylene terephthalate and/or co-polyethylene terephthalate.

In a preferred embodiment of the invention, the total of the proportion of PEN, copolymers and/or blends thereof on the one hand and the proportion of polyethylene terephthalate and/or co-polyethylene terephthalate on the other hand is more than 80 wt. %, preferably more than 90 wt. %, more preferably more than 95 wt. % and in particular more than 97 wt. %, based on the total weight of the base body in each case.

If PEN is used as a blend and/or copolymer, preferred further blend components and preferred copolymers and preferred ratios are those already mentioned above in relation to the binding component. The polymers, compositions and ratios of the core/sheath binding fibers used for the production of the binding component and of the core/sheath matrix fibers used for the production of the matrix fibers may be selected described independently of one another.

Thus, the polymers of the binding fiber sheath polymer and the matrix fiber sheath polymer may be different. This makes it possible to easily set different melting ranges. According to the invention, the binding fiber sheath polymer and the matrix fiber sheath polymer preferably comprise the same polymers or copolymers or blends, which, however, as explained above, differ in their crystallinity prior to the thermal treatment.

The retention of the fiber structure of the matrix fibers during the thermal treatment in the production of the fabric can be achieved by setting a higher degree of crystallinity of the matrix fibers compared to the sheath of the core/sheath binding fibers, as described above.

The fibers used to produce the fabric can be filaments, staple fibers and/or short-cut fibers. According to the invention, the fibers are preferably staple fibers and/or short-cut fibers. Staple fibers or short-cut fibers can be produced and laid by a wide variety of known production methods, for example carding methods, airlaid, wetlaid methods.

In one embodiment of the invention, the proportion of the PEN or its copolymers or blends is from 5 to 95 wt. %, preferably from 5 to 75 wt. %, in particular from 10 to 60 wt. %, based on the total weight of the fabric in each case. Particularly preferably, the PEN, or its copolymers, is used in a rather lesser amount. In this case, it is advantageous that the expensive PEN can be used in a material-saving manner in order to increase the stability of the fabric.

The proportion of the binding component is likewise preferably from 5 to 75 wt. %, preferably from 5 to 65 wt. %, in particular from 10 to 55 wt. %, based on the total weight of the fabric in each case.

The fiber diameter of the core/sheath binding fibers and of the matrix fibers, independently of one another, is preferably in the range of 0.1 to 20 dtex, more preferably in the range of 0.1 to 15 dtex, particularly preferably in the range of 0.1 to 10 dtex. More preferably, the length of the core/sheath binding fibers is from 1 to 90 mm and/or the length of the matrix fibers is from 1 to 90 mm, unless they are present as filaments. Since the shape of at least the core/sheath binding fibers can naturally change during the thermal treatment, the aforementioned fiber dimensions are related to the state prior to the thermal treatment.

In addition to the aforementioned matrix fibers and binding components, the fabric preferably contains no further fibers or further fibers only in a proportion of less than 60 wt. %, for example from 0 to 60 wt. % and/or from 5 to 60 wt. %. In the case that the fabric contains further fibers, these further fibers are preferably formed as monofibers. These further fibers likewise preferably have a melting point or decomposition point of more than 210° C., for example from 210 to 2000° C., particularly preferably from 220 to 2000° C. and in particular from 250 to 2000° C. Moreover, the further fibers are preferably selected from the group consisting of: polyester fibers, in particular polybutylene terephthalate fibers; polyamide, especially polyamide 6.6 (Nylon®), polyamide 6.0 (Perlon®), meta-aramid, para-aramid; aromatic polyamides, polyvinyl chloride, polyacrylonitrile, polyimide, polyamide-imide, polytetrafluoroethylene (Teflon®), phenolic resin, LCP (liquid crystal polymer), glass, basalt fibers. Particularly preferred are the further fibers selected from the group consisting of: polyamide, poly-p-phenylene terephthalamide, poly-m-phenylene terephthalamide, polyester fibers and mixtures thereof. Owing to its good mechanical properties, thermal stability and cost-effectiveness, polyester and in particular polyethylene terephthalate, meta-aramid and/or para-aramid are particularly preferred.

In a further preferred embodiment of the invention, the textile fabric is characterized by a weight-related tensile strength in the machine direction (MD) of more than 0.25 N/g, for example from 0.25 to 12 N/g, preferably from 0.5 to 10 N/g and particularly preferably from 0.75 to 8 N/g.

The high tensile strength is advantageous, for example, for the use of the fabric for the sheathing of conductors, since a certain strength is necessary for the conductor manufacturing process, in which the materials are applied, for example, as wrapping. In principle, however, the tensile strengths can be set to preferred values, for example from 15 to 800 N and/or from 25 to 700 N and/or from 35 to 600 N, as measured in accordance with DIN ISO 9073-3, depending on the respective applications. According to a preferred embodiment of the invention, the textile fabric has the aforementioned high tensile strengths in the machine direction even at low thicknesses, for example below 3 mm, such as in the range of 0.02 mm to 2 mm.

The textile fabric can be produced in a wide variety of thickness ranges. This makes it possible to use a customized textile fabric with regard to a wide variety of applications in the field of electrical insulation. It has proven to be preferable for the textile fabric to have thicknesses in accordance with DIN EN 9073-2 in the range of 0.01 to 2 mm, 0.01 to 1.7 mm and/or 0.02 to 1.5 mm.

Because of their small thickness and good deformability, such fabrics can be processed particularly well.

The fabric according to the invention is suitable for a wide variety of applications, preferably for the production of electrical insulating materials, for example for the electrical insulation of electric motors, generators or transformers, in particular for the production of (flexible) laminates with films in the core as insulation for, for example, slots or sliding covers and/or as a layer separator for phase separation. To this end, it can be manufactured in a wide variety of forms, for example in the form of a slot lining, a closure, a wedge, a bar, as a wrapping, as a separating layer in annular form or bandage in the cable. The fabric according to the invention is likewise particularly suitable for use as a carrier material for conductive strips.

For use in the form of a slot lining and/or for the insulation of conductors, it must be taken into account that the installation space or the available space is greatly limited in this case. It is therefore advantageous if the textile fabric does not lead to a sharp increase in the thickness of the laminate.

In these cases, thicknesses of less than 1 mm, for example between 0.01 mm to 0.07 mm, between 0.02 mm to 0.5 mm, and/or from 0.01 mm to 0.48 mm are preferred.

The basis weight can vary within wide ranges. The textile fabric preferably has a basis weight in accordance with DIN EN 29073-1 of 20 to 400 g/m2, preferably of 20 to 300 g/m2, in particular of 30 to 250 g/m2. Fabrics according to the invention with such basis weights have excellent stability.

The textile fabric preferably has an air permeability measured in accordance with DIN EN ISO 9237 of 5 to 800 l/sqm*sec, preferably of 10 to 700 l/sqm*sec and in particular of 15 to 600 l/sqm*sec. By weight, this means an air permeability of the fabric according to the invention of preferably 0.15 to 200 l/sec*g, preferably of 0.25 to 175 l/sec*g and in particular of 0.35 to 150 l/sec*g.

It has been found that with the aforementioned air permeabilities, there is a particularly good impregnation behavior. In a preferred embodiment of the invention, the fabric according to the invention has a coating and/or impregnation with a resin.

It is conceivable for the fabric to have a reinforcing layer, for example a plastic film. As a result, a fabric with high mechanical strength and low weight is obtained.

According to a preferred embodiment, the fabric is of a multilayer construction. The fabric preferably contains at least one further layer in addition to the base body. The further layers could be formed as spunbonded layers or staple fiber layers. The further layers may differ from one another in their function, production method, type of fiber, polymers contained and/or their color.

It is also conceivable to subject the textile fabric to a subsequent treatment or processing of a chemical nature, such as an anti-pilling treatment, a hydrophilization or hydrophobing, an antistatic treatment, a treatment for improving the fire resistance and/or for changing the tactile properties or the sheen, a treatment of a mechanical nature, such as roughening, sanforization, sanding or a treatment in the tumbler and/or a treatment for changing the appearance, such as dyeing or printing.

For some applications, it may further be provided to subsequently provide the textile fabric with one or more additives, for example to coat them, the additives being selected, for example, from carbonates, in particular, calcium carbonate, soots, in particular conductive soot, graphites, ion exchange resins, activated carbons, silicates, in particular talc, clay, mica, silica, zeolites, chalk, calcium and barium sulfate, aluminum hydroxide, glass fibers and beads as well as wood flour, cellulose powder, powdery super absorbers, perlite, cork or plastic granules, ground thermoplastics, cotton fibers, carbon fibers, in particular ground carbon fibers and mixtures thereof. By adding a filler and/or additive, for example, the permeability for liquid and/or air can be changed and the thermal and/or electrical conductivity of the material can be controlled. In order to improve the adhesion of the additive and/or filler, an adhesive/binder can be used, for example based on polyvinyl alcohol, polyacrylates, polyurethanes, styrene butadiene rubber or nitrile butadiene rubber, polyester resins, epoxy resins, polyurethane resins.

In a preferred embodiment of the invention, the layers in the fabric according to the invention, preferably the at least one layer and/or the further layers of the base body, are formed as laid fabrics, woven fabrics, knitted fabrics, warp-knitted fabrics, film, foil, fleece or non-woven fabric. As a result, a fabric with high mechanical strength can be obtained. According to the invention, the at least one layer is particularly preferably formed as a non-woven.

The invention also relates to a method for producing the textile fabric according to the invention, comprising the following method steps:

providing core/sheath binding fibers in which the sheath comprises PEN, copolymers and/or blends thereof, forming a layer containing the core/sheath binding fibers, applying temperature to the layer, wherein the temperature is above the cold crystallization temperature of the binding fiber sheath polymer so that a textile fabric is obtained which comprises a base body made of at least one layer, the at least one layer having PEN, copolymers and/or blends thereof as a binding component.

The first method step comprises the provision of core/sheath binding fibers in which the sheath comprises PEN, copolymers and/or blends thereof. The application of temperature to the layer could take place in an oven and/or in a calender, in air or in an inert atmosphere or under vacuum. Exemplary temperatures are in the range of 100 to 290° C., preferably 110 to 280° C. In a preferred embodiment of the invention, a treatment with pressure takes place simultaneously or downstream. In the case of treatment with a calender, preferred pressures are line pressures of 20 to 350 N/mm, preferably of 40 to 300 N/mm and in particular of 50 to 275 N/mm.

According to the invention, the materials already discussed above in relation to the fabric in the described forms, proportions, etc. are preferably used as starting materials. Staple fibers (preferably having a length of 1 to 120 mm) and/or continuous fibers (filaments) can be used as core/sheath binding fibers and/or matrix fibers. The core/sheath binding fibers and/or matrix fibers have a titer of 0.1 to 50 dtex, more preferably of 1.0 to 40 dtex.

In order to avoid repetitions, reference is made at this point to the above statements.

The invention is explained in more detail below with reference to several examples:

Four different fabrics according to the invention are produced by way of example:

1. Production of Different Fabrics

First, a fiber mixture consisting of the following fibers is produced in a mixing ratio of 60:40 (matrix fiber:core/sheath binding fiber).

Matrix fiber:

Core/sheath fiber (sheath PEN/core PET)

Fiber titer: 4.8 dtex

Fiber length of 50 mm.

PEN crystallinity: 32%

Core/Sheath Binding Fiber for the Production of the Binding Component:

Core/sheath binding fiber (sheath PEN/core PET)

Fiber titer: 10.8 dtex

Fiber length of 50 mm.

PEN crystallinity: 17%

A fibrous web is laid on a random non-woven card with MD orientation and thermally solidified by means of pressure and temperature in a calender with a steel/steel roller configuration at temperatures of 160 to 250° C. and line pressures of 50 to 250 N/mm. Exact setting parameters must be adapted to the corresponding production speeds.

Fabrics 1-4 according to the invention are obtained thereby.

2. Measurement of Relevant Parameters of the Fabric Produced Under 1

| Example | Weight [g/sqm] | Thickness [μm] | MD maximum tensile force, by weight [N/g] | MD maximum tensile elongation, by weight [%] | CD maximum tensile force, by weight [N/g] | CD maximum tensile elongation, by weight [%] | Air permeability, by weight [1/sec * g] |
|---|---|---|---|---|---|---|---|
| Comparative example | 60 | 74 | 3.42 | 0.35 | 1.32 | 0.23 | 0.50 |
| 1 | 60 | 70 | 0.62 | 0.03 | 0.32 | 0.03 | 4.50 |
| 2 | 60 | 69 | 0.78 | 0.03 | 0.42 | 0.03 | 4.25 |
| 3 | 74 | 75 | 0.82 | 0.03 | 0.53 | 0.03 | 0.96 |
| 4 | 97 | 96 | 0.89 | 0.02 | 0.57 | 0.02 | 0.55 |

| Example | Weight [g/sqm] | Thickness [μm] | MD maximum tensile force [N] | MD maximum tensile elongation [%] | CD maximum tensile force [N] | CD maximum tensile elongation [%] | Air permeability [1/sec * g] |
|---|---|---|---|---|---|---|---|
| Comparative example | 60 | 74 | 205 | 21 | 79 | 14 | 30 |
| 1 | 60 | 70 | 37 | 2 | 19 | 2 | 270 |
| 2 | 60 | 69 | 47 | 2 | 25 | 2 | 255 |
| 3 | 74 | 75 | 61 | 2 | 39 | 2 | 71 |
| 4 | 97 | 96 | 86 | 2 | 55 | 2 | 53 |

High-density non-wovens could be produced in three different weight variations. Example 1 was compressed at 50 N/mm, Example 2 at 100 N/mm. There was a rather slight influence on the thickness of the material, or the air permeability could only be increased slightly, but with a simultaneous increase in the MD and CD maximum tensile force. At higher basis weights, higher mechanical strengths and decreasing air permeabilities were achieved in accordance with expectations.

Interestingly, there was no influence on the elongation at break.

3. Testing of the Fabrics Manufactured Under 1. for High-Temperature Resistance by Means of Storage Tests at 160° C. or 200° C.

The fabric according to the invention and the comparative example are subjected to storage tests at 160° C. or 200° C. The results are shown in FIGS. 1-4.

Comparison storages were set up in order to demonstrate the improved thermal stability of the non-woven according to the invention in comparison with standard polyethylene terephthalate products. A 60 g/m$^2$ non-woven consisting of 100% PET was used as the reference material.

For storage, the samples were punched in DIN A4 size and stored in an oven (Memmert, type U30) at 160° C. or 200° C. and medium air circulation setting for 4 weeks. Storage was carried out on a center rail in the furnace. Three samples were used per non-woven type and week, that is to say a total of 12 DIN A4 samples per example. A test specimen was punched from each DIN A4 sample and its maximum tensile force or maximum tensile elongation was determined in accordance with DIN ISO 9073-3. In order to determine the decrease in properties after storage, the mean value was determined from three individual measurements (per week and variant) and the measured value was normalized to the initial value before storage.

Figure 2:
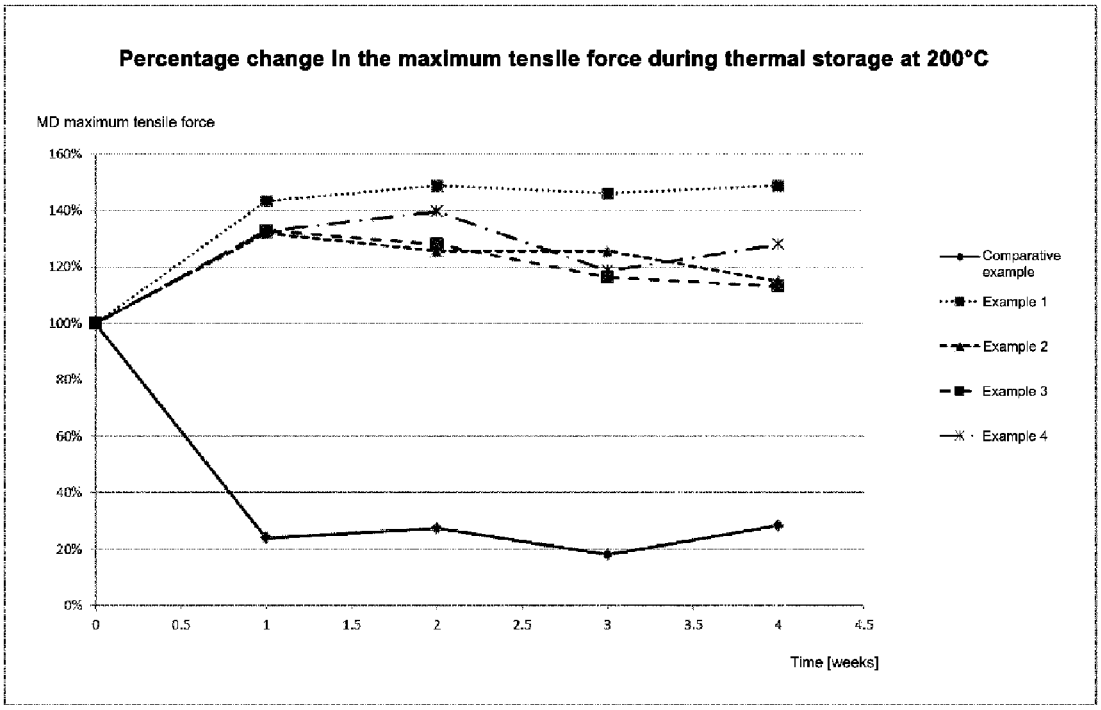

For this purpose, the relative decrease in the maximum tensile force was used as a measure of the thermal stability of the non-woven. As expected, a significant decrease in the MD maximum tensile force was found in Comparative Example 1. Thus, Comparative Example 1 shows a constant loss of maximum tensile force up to 28% of the original value after 4 weeks at 200° C. (FIGS. 1-2). The variations visible here are within the measurement accuracy of the stored samples. If, on the other hand, the non-wovens according to the invention are considered, it is surprisingly found that the maximum tensile force does not decrease but initially even rises and then remains virtually constant. The increases are in an order of magnitude of 20 to 50%. If the storage temperatures are compared at 160° C. with those at 200° C., it becomes apparent, as is to be expected according to Arhenius, that an acceleration of the processes takes place, i.e., a greater decrease in the maximum tensile force of the non-woven based on PET. The results are shown in FIGS. 1 and 2.

Analogously to the maximum tensile force, the percentage decrease in the maximum tensile elongation was investigated, i.e. the elongation of the test specimen in percent upon failure of the test specimen after measurement of the maximum tensile force in accordance with DIN EN ISO 9073-3. Analogously to the measurement results in FIGS. 1 and 2, a strong relative decrease in the values in the case of the comparative non-woven becomes apparent. The elongation decreases to 10% of the original value at 160° C. storage temperature, at 200° C. storage temperature to 3% of the original value. The decrease in the case of PEN/PET-based non-wovens is significantly lower. At 160° C., a decrease to 47 to 66% of the original value occurs after 4 weeks, in the case of a storage temperature of 200° C. to 45 to 60% of the original value.

On the basis of the measured values illustrated, it can therefore be concluded that the PEN sheath protects the PET core and thus has a stabilizing effect.

Figure 3:
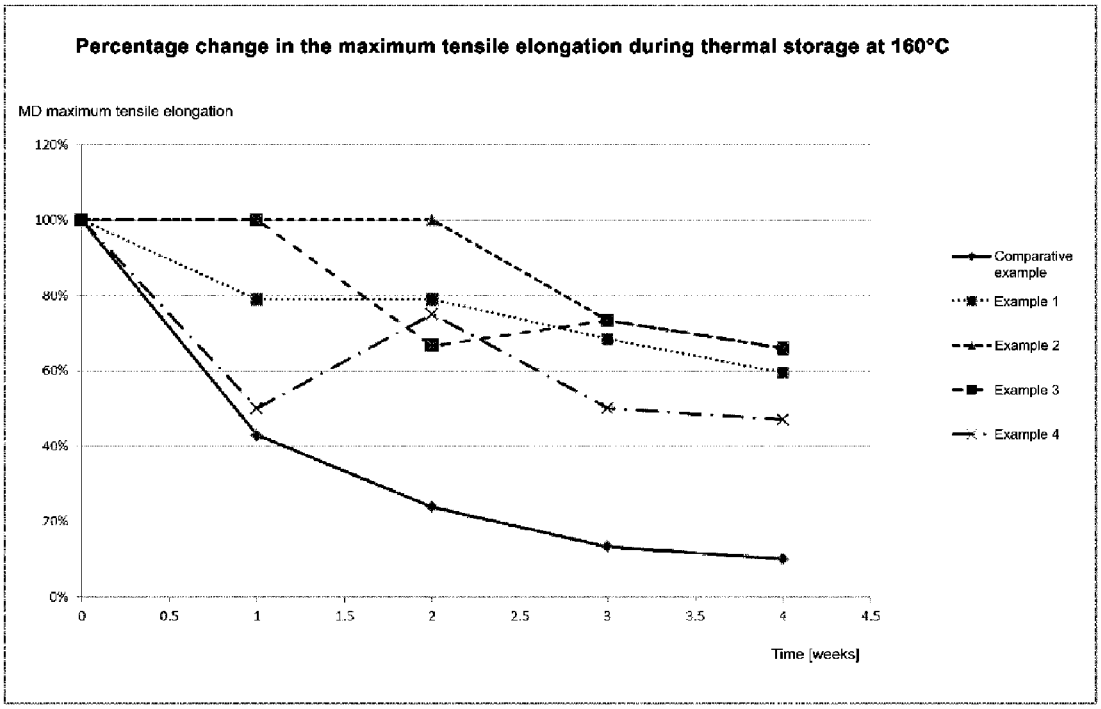
Figure 4:
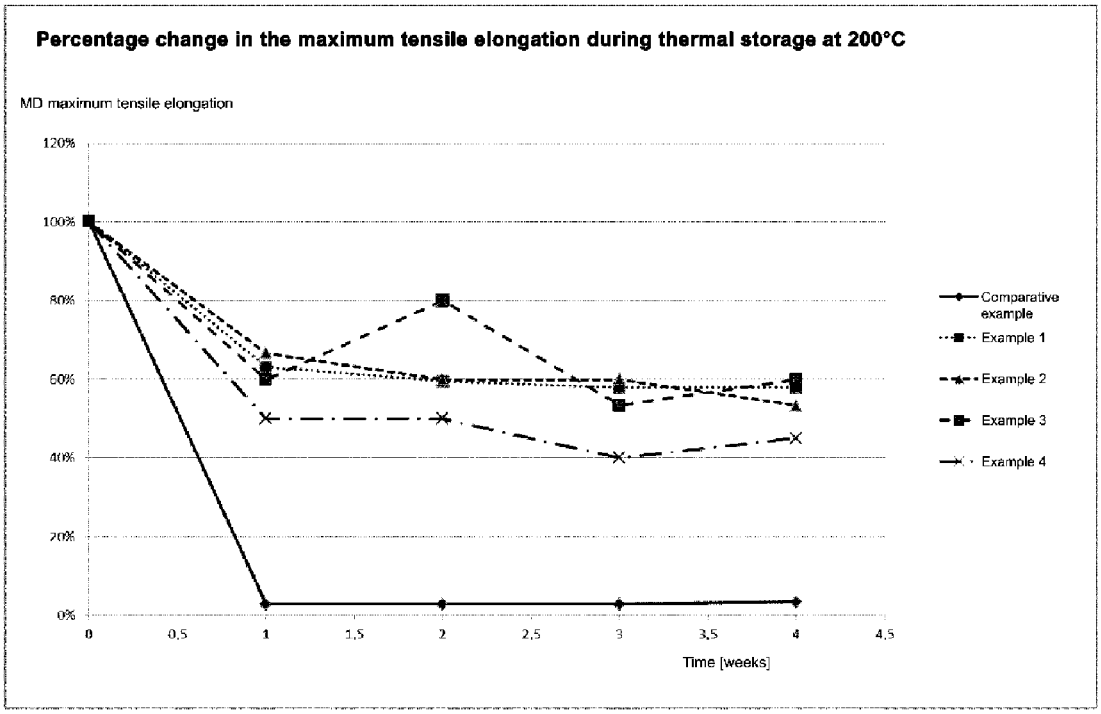

The results are shown in FIGS. 3 and 4.

4. Measurement Method for Determining Melting Points, Decomposition Points, Fusion and Crystallization Enthalpies, Glass Transition Temperatures and Crystallinity Glass transition temperatures, melting points and decomposition points, crystallization and fusion enthalpies were determined by means of DSC according to DIN EN ISO 11357-2 (edition: 2014-07). The melting points correspond to the temperatures at the maxima of the endothermic fusion enthalpy. The exothermic crystallization enthalpies and the endothermic fusion enthalpies result from the respective integrals of the measuring curves. In all cases, the first heating curve was used to determine the values.

The degrees of crystallinity (K %) can be calculated from the ratio of the fusion and crystallization enthalpies ("Thermoplastic Materials: Properties, Manufacturing Methods, and Applications", Cristopher C. Ibeh, CRC Press, ISBN: 13:978-1-4200-9384-1, pages 105 et seqq.) according to:

$$K\%=(\Delta H_{fusion.}-\Delta_{cryst.})\times 100\%/\Delta H_{cryst.\ 100\%}$$

5. Determination of the Crystallization Enthalpies and Fusion Enthalpies of the Fibers Used for the Production of the Fabrics of Examples 1 to 4

Testing apparatus: Mettler Toledo
Cooling: Active liquid nitrogen cooling
Purge gas: Nitrogen ($N_2$ 99.999%) 30 ml/min
Crucible: Aluminum 40 μl
Original sample weight (mg): 8 to 12
Sample preparation: Cut with scalpel

| | | | | | | | | | | | | |
|---|---|---|---|---|---|---|---|---|---|---|---|---|
| Tempering (° C.): | 25 | → | 300 | // | 300 | → | 25 | // | 25 | → | 300 |
| Heating rates | | 10 | | | | 10 | | | | 10 | |
| Holding times | 5 | | | 5 | | | | 5 | | | |

In order to determine the integrals, the minimum between the two crystallization enthalpies was defined as the limit. An analogous method was used in the case of the fusion enthalpy of the matrix fibers.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A textile fabric, comprising:

a base body having at least one layer, the at least one layer comprising polyethylene naphthalate (PEN), copolymers of PEN, and/or blends thereof as a binding component, wherein the binding component is obtainable by applying temperatures above a glass transition temperature of a binding fiber sheath polymer to core/sheath binding fibers, in which the binding fiber sheath polymer contains PEN, copolymers of PEN, and/or blends thereof, and wherein the binding component is producible starting from core/sheath binding fibers in which the binding fiber sheath polymer comprises PEN, copolymers of PEN, and/or blends thereof having a non-zero degree of crystallinity of less than 80%, wherein the binding fiber sheath polymer has a higher melting point than the binding fiber core polymer, wherein a difference in the melting temperatures of the binding fiber sheath polymer and of the binding fiber core polymer is at least 2.5° C., wherein the fabric comprises matrix fibers, wherein a difference in a degree of crystallinity between the sheath of the core/sheath binding fibers and a degree of crystallinity of the matrix fibers prior to applying temperatures above a glass transition temperature of the binding fiber sheath polymer to core/sheath binding fibers is at least 5%, and wherein the degree of crystallinity of the matrix fibers is higher than the degree of crystallinity of the sheath of the core/sheath binding fibers.

2. The textile fabric according to claim 1, wherein the binding component comprises a deformed fiber structure up to a completely fused continuous phase.

3. The textile fabric according to claim 1, wherein after thermal storage at 160° ° C. for 1 week, the fabric exhibits a percentage reduction in a maximum tensile force in at least one direction of less than 5%, and/or an increase in the maximum tensile force in at least one direction of at least 1%.

4. The textile fabric according to claim 1, wherein the PEN, copolymers of PEN, and/or blends thereof in the binding fiber sheath polymer have a cold crystallization temperature in a range of 70 to 200° C.

5. The textile fabric according to claim 1, wherein the PEN, copolymers of PEN, and/or blends thereof in the binding fiber sheath polymer and/or in the binding component have a melting temperature in a range of 180 to 320° C.

6. The textile fabric according to claim 1, wherein a ratio between the binding fiber core polymer and the binding fiber sheath polymer is from 90:10 to 10:90 (core:sheath weight ratio in wt. %).

7. The textile fabric according to claim 1, wherein the matrix fibers comprise core/sheath matrix fibers comprising a matrix fiber sheath polymer and a matrix fiber core polymer.

8. The textile fabric according to claim 7, wherein the matrix fiber sheath polymer is selected from same type of polymers, copolymers, and/or blends as the binding fiber sheath polymer, and/or wherein the matrix fiber core polymer is selected from same type of polymers, copolymers, and/or blends as the binding fiber core polymer.

9. The textile fabric according to claim 1, wherein a total of a proportion of PEN, copolymers of PEN, and/or blends thereof and a proportion of polyethylene terephthalate and/or co-polyethylene terephthalate is more than 80 wt. % based on a total weight of the base body.

10. The textile fabric according to claim 1, wherein a proportion of the PEN, copolymers of PEN, and/or blends thereof is 5 to 95 wt. % based on a total weight of the fabric.

11. A method of using the textile fabric according to claim 1 for production of electrical insulating materials, comprising:

providing the textile fabric as carrier material for conductive strips and/or as layer separator for phase separation.

12. A method for producing the textile fabric according to claim 1, comprising the following method steps:

providing core/sheath binding fibers in which the sheath comprises PEN, copolymers of PEN, and/or blends thereof;

forming a layer containing the core/sheath binding fibers;

applying temperature to the layer, the temperature being above a cold crystallization temperature of the binding fiber sheath polymer so as to obtain the textile fabric.

13. The textile fabric according to claim 1, wherein the non-zero degree of crystallinity is up to 70%.

14. The textile fabric according to claim 13, wherein the non-zero degree of crystallinity is up to 60%.

15. The textile fabric according to claim 3, wherein the percentage reduction in the maximum tensile force in at least one direction is from of 0 to 4%, and/or the increase in the maximum tensile force in at least one direction is from 5 to 100%.

16. The textile fabric according to claim 4, wherein the cold crystallization temperature is in a range of 80 to 190° C.

17. The textile fabric according to claim 1, wherein the binding fiber sheath polymer contains at least one homopolymer of PEN.

18. The textile fabric according to claim 1, wherein the glass transition temperature of the binding fiber sheath polymer is higher by at least 5° C. than a glass transition temperature of a binding fiber core polymer.

* * * * *